US009385475B1

(12) United States Patent
Barna

(10) Patent No.: US 9,385,475 B1
(45) Date of Patent: Jul. 5, 2016

(54) INDICATING HANDLES FOR ELECTRICAL CONNECTORS

(71) Applicant: Kyle Steven Barna, Syracuse, NY (US)
(72) Inventor: Kyle Steven Barna, Syracuse, NY (US)
(73) Assignee: Cooper Technologies Company, Houston, TX (US)

( * ) Notice: Subject to any disclaimer, the term of this patent is extended or adjusted under 35 U.S.C. 154(b) by 0 days.
(21) Appl. No.: 14/615,619
(22) Filed: Feb. 6, 2015
(51) Int. Cl.
*H01R 13/639* (2006.01)
(52) U.S. Cl.
CPC ..... *H01R 13/639* (2013.01)
(58) Field of Classification Search
CPC ..... H01R 13/639; H01R 13/6392
USPC ..... 439/369
See application file for complete search history.

(56) References Cited

U.S. PATENT DOCUMENTS 1,510,977 A * 10/1924 Clark ..... H01R 13/6278 439/369
2,406,567 A * 8/1946 Schueneman ..... H01R 13/6392 439/369
2,761,109 A * 8/1956 Hacker ..... H01R 13/6392 24/370
2,903,669 A * 9/1959 Gilman ..... H01R 13/6392 174/135
3,029,408 A * 4/1962 Anderson ..... H01R 13/6392 439/369
3,097,034 A * 7/1963 Jamrosy ..... H01R 13/6392 439/369
3,281,755 A * 10/1966 Trager ..... H01R 13/639 403/286
3,383,639 A * 5/1968 Anderson ..... H01R 13/6392 403/286
3,596,946 A 8/1971 Burton et al.
3,609,638 A * 9/1971 Darrey ..... H01R 13/6392 24/332
3,888,559 A 6/1975 Geib
4,145,105 A * 3/1979 Dobson ..... H01R 13/6392 439/369
4,169,643 A * 10/1979 Gallagher ..... H01R 13/6392 439/369
4,440,465 A * 4/1984 Elliott ..... H01R 13/6392 24/326
4,655,531 A * 4/1987 Delaney ..... H01R 13/6392 439/450
4,690,476 A * 9/1987 Morgenrath ..... H01R 13/6392 439/369
4,721,475 A * 1/1988 Burke, Jr. ..... H01R 13/6392 439/133
4,895,530 A 1/1990 Gugelmeyer et al.
4,906,122 A 3/1990 Barrett et al.
4,907,984 A * 3/1990 Keller ..... H01R 13/6392 24/306
4,925,399 A * 5/1990 Bosworth ..... H01R 13/6392 439/369
4,940,424 A * 7/1990 Odbert ..... H01R 13/6392 439/314
4,998,891 A * 3/1991 Bresko ..... H01R 13/639 439/367
5,104,335 A * 4/1992 Conley ..... H01R 13/6392 439/369
5,133,671 A * 7/1992 Boghosian ..... G09F 3/037 24/16 PB
5,167,524 A * 12/1992 Falcon ..... H01R 13/6392 439/369
5,259,782 A * 11/1993 Giffin ..... H01R 13/6392 439/314

(Continued)

FOREIGN PATENT DOCUMENTS

JP 5198337 8/1993
JP 6290831 10/1994

*Primary Examiner* — Ross Gushi
(74) *Attorney, Agent, or Firm* — King & Spalding LLP

(57) ABSTRACT

An electrical connector is described herein and can include a first connector end and a second connector end removably coupled to the first connector end. The first connector end can include a first collar forming a first cavity, where the first collar comprises a connector coupling feature. The first connector end can also include a first handle disposed on a first outer surface of the first collar, wherein the first handle comprises a handle coupling feature. The second connector end can include a second collar forming a second cavity, where the second collar includes a complementary connector coupling feature, where the connector coupling feature of the first connector end couples with the complementary connector coupling feature of the second connector end. The second connector end can also include a second handle disposed on a second outer surface of the second collar that includes a complementary handle coupling feature.

20 Claims, 4 Drawing Sheets

(56) References Cited

U.S. PATENT DOCUMENTS 5,328,384 A * 7/1994 Magnuson ..... H01R 13/6392 439/369
5,536,173 A 7/1996 Fujitani et al.
5,556,284 A 9/1996 Itou et al.
5,627,448 A 5/1997 Okada et al.
5,641,310 A 6/1997 Tiberio, Jr.
5,676,560 A 10/1997 Endo et al.
5,685,732 A * 11/1997 Lane ..... H01R 13/6392 24/523
5,751,135 A 5/1998 Fukushima et al.
5,823,813 A 10/1998 Dye
5,913,693 A * 6/1999 Fetterolf ..... H01R 13/6392 24/459
6,203,349 B1 3/2001 Nakazawa
6,217,366 B1 * 4/2001 Weisstock ..... H01R 13/6392 439/367
6,227,891 B1 5/2001 Collin et al.
6,319,044 B1 * 11/2001 Stekelenburg ..... H01R 13/6392 439/369
6,336,822 B1 1/2002 Luzzoli
7,306,472 B2 12/2007 Matsumoto et al.
7,407,405 B1 * 8/2008 Slenczka ..... H01R 13/6392 439/369
7,442,067 B1 * 10/2008 Amaral ..... H01R 13/639 439/367
7,887,360 B2 * 2/2011 Andrade ..... H01R 13/6392 439/369
8,052,480 B2 11/2011 Hauser
8,177,575 B2 5/2012 Katagiyama et al.
8,197,278 B2 * 6/2012 Reusche ..... H01R 13/6392 439/320
9,077,111 B2 * 7/2015 Brown ..... H01R 13/6392
2004/0166718 A1 * 8/2004 Yoest ..... H01R 13/6392 439/369
2006/0035508 A1 * 2/2006 Stekelenburg ..... H01R 13/6392 439/369
2009/0064465 A1 * 3/2009 Andrade ..... H01R 13/6392 24/115 H

* cited by examiner

INDICATING HANDLES FOR ELECTRICAL CONNECTORS

TECHNICAL FIELD

The present disclosure relates generally to electrical cable connectors and more particularly to systems, methods, and devices for indicating handles for electrical cable connectors that are coupled to each other.

BACKGROUND

Electrical connectors are used in a number of applications (e.g., photovoltaic (PV) solar) and have a number of different sizes and configurations. Larger sized electrical connectors often provide termination for large cables and/or for a large number of conductors. These larger sized electrical connectors can weigh so much that they can be very difficult to lift and manage. In some cases, handles are affixed to one or both connector ends of the electrical connector to help a user lift and/or manipulate the electrical connector.

SUMMARY

In general, in one aspect, the disclosure relates to an electrical connector having a first connector end and a second connector end removably coupled to the first connector end. The first connector end of the electrical connector can include a first connector body having a connector coupling feature. The first connector end of the electrical connector can also include a first handle disposed on a first outer surface of the first connector body, where the first handle includes a handle coupling feature. The second connector end of the electrical connector can include a second connector body having a complementary connector coupling feature, where the connector coupling feature of the first connector end couples with the complementary connector coupling feature of the second connector end. The second connector end of the electrical connector can also include a second handle disposed on a second outer surface of the second connector body, where the second handle includes a complementary handle coupling feature. The handle coupling feature can align with the complementary handle coupling feature when the connector coupling feature couples to the complementary connector coupling feature.

In another aspect, the disclosure can generally relate to a connector end of an electrical connector. The connector end can include a connector body having a connector coupling feature. The connector end can also include a handle disposed on an outer surface of the connector body, where the handle comprises a handle coupling feature. The connector coupling feature can be configured to couple to a complementary connector coupling feature of another connector body of a complementary connector end. The handle coupling feature can be configured to align with and couple to a complementary handle coupling feature of a complementary handle of the complementary connector end.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION

Figure 1:
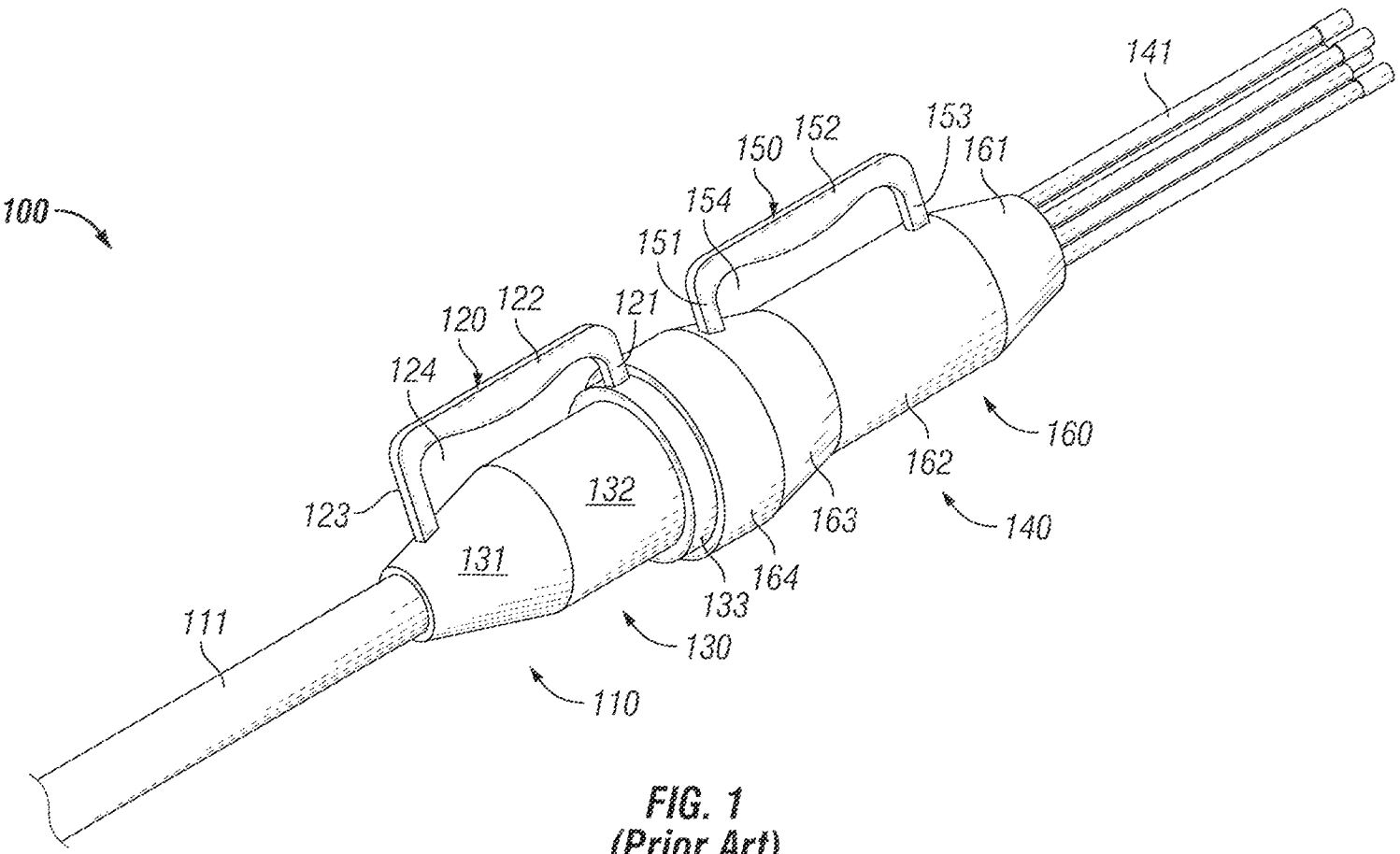
FIG. 1 (Prior Art)
FIG. 1 shows an electrical connector with handles in accordance with example embodiments known in the art.

In general, example embodiments provide systems, methods, and devices for electrical connectors with indicating handles. Example electrical connectors with indicating handles provide a number of benefits. Such benefits can include, but are not limited to, indication of the status of the mechanical coupling between the connector ends of the electrical connector, more easily facilitate the decoupling of the connector ends of an electrical connector, and provide for compliance with safety protocols during maintenance operations.

The example embodiments discussed herein can be directed to any type of application (e.g., a PV solar system, generation control systems, branch circuit management and protection). A user may be any person that interacts with example electrical connectors with indicating handles. Examples of a user may include, but are not limited to, an engineer, an electrician, an instrumentation and controls technician, a mechanic, an operator, a consultant, a contractor, and a manufacturer's representative.

The electrical connectors (or components thereof, such as the handles) described herein can be made of one or more of a number of suitable materials to allow the electrical connector to meet certain standards and/or regulations while also maintaining durability in light of the one or more conditions under which the example electrical connectors can be exposed. Examples of such materials can include, but are not limited to, aluminum, stainless steel, fiberglass, glass, plastic, and rubber.

Any components (e.g., handle) of example electrical connectors, or portions thereof, described herein can be made from a single piece (as from a mold, injection mold, die cast, or extrusion process). In addition, or in the alternative, one or more components (or portions thereof) of an electrical connector can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

In the foregoing figures showing example embodiments of electrical connectors with indicating handles, one or more of the components shown may be omitted, repeated, and/or substituted. Accordingly, example embodiments of electrical connectors with indicating handles should not be considered limited to the specific arrangements of components shown in any of the figures.

In certain example embodiments, an electrical connector with indicating handles is subject to meeting certain standards and/or requirements. For example, the National Electric Code (NEC), the National Electrical Manufacturers Association (NEMA), and the Institute of Electrical and Electronics Engineers (IEEE) set standards as to electrical enclosures, wiring, and electrical connections. Use of example embodiments described herein meet (and/or allow a corresponding device to meet) such standards when required. In some (e.g., PV solar) applications, additional standards particular to that application may be met by the example electrical connectors with indicating handles described herein.

Example embodiments of electrical connectors with indicating handles will be described more fully hereinafter with reference to the accompanying drawings, in which example embodiments of electrical connectors with indicating handles are shown. Electrical connectors with indicating handles may, however, be embodied in many different forms and should not be construed as limited to the example embodiments set forth herein. Rather, these example embodiments are provided so that this disclosure will be thorough and complete, and will fully convey the scope of electrical connectors with indicating handles to those of ordinary skill in the art. Like, but not necessarily the same, elements (also sometimes called components) in the various figures are denoted by like reference numerals for consistency.

Terms such as "first," "second," "top," "side," "width," "length," "bottom," "thickness," "proximal", and "distal" are used merely to distinguish one component (or part of a component or state of a component) from another. Such terms are not meant to denote a preference or a particular orientation, and are not meant to limit embodiments of electrical connectors with indicating handles. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 depicts an electrical connector 100 with handles (handle 120, handle 150) in accordance with example embodiments known in the art. The electrical connector 100 includes two connector ends (connector end 110, connector end 140) that are electrically and mechanically coupled to each other. Connector end 110 includes a connector housing 130, handle 120 coupled to the connector housing 130, and an electrical cable 111. Inside of the connector housing 130 is disposed a distal end of the electrical cable 111. The electrical cable 111 includes one or more electrical conductors, where each electrical conductor terminates with a connector body (hidden from view) disposed within the connector housing 130.

The distal end of the connector body 130 (the portion of the connector body 130 opposite where the electrical cable 111 is inserted) can be configured with one or more male conductive pins or with one or more female conductor receivers. The connector body 130 can have one or more portions. In this case, the connector body 130 can include a proximal portion 131, a middle portion 132, and a distal portion 133. The handle 120 can be coupled to one or more portions of the connector body 130. In this case, the handle 120 is coupled to the proximal portion 131 and the distal portion 133.

The handle 120 can have any of a number of shapes. In this case, the handle has a "U" shape, with a main section 122 that is coupled to an end section 123 at one end of the main section 122 and to another end section 121 at the other end of the main section 122. The handle 120, when coupled to the connector body 130, can form an opening 124 through which a user's hand or some other object can be disposed.

Similarly, connector end 140 includes a connector housing 160, handle 150 coupled to the connector housing 160, and an electrical cable 141. Inside of the connector housing 160 is disposed a distal end of the electrical cable 141. The electrical cable 141 includes one or more electrical conductors, where each electrical conductor terminates with a connector body (hidden from view) disposed within the connector housing 160.

The distal end of the connector body 160 (the portion of the connector body 160 opposite where the electrical cable 141 is inserted) can be configured with one or more male conductive pins or with one or more female conductor receivers. The configuration (e.g., size, shape, gender) of the distal end of the connector body 160 is complementary to the configuration of the distal end of the connector body 130. For example, if the distal end of the connector body 160 has nine male conductive pins that form an octagon that is substantially centered on the face of the connector body 160, then the distal end of the connector body 130 has 9 female conductor receivers that form an octagon that is substantially centered on the face of the connector body 130.

The connector body 160 can have one or more portions. In this case, the connector body 160 can include a proximal portion 161, a main portion 162, a distal portion 163, and a connector coupling portion 164. The handle 150 can be coupled to one or more portions of the connector body 160. In this case, the handle 150 is coupled to the main portion 162 and the distal portion 163. The connector coupling portion 164 can be movable (e.g., rotatable) with respect to the rest of the connector body 160 and can include one or more coupling features (e.g., mating threads disposed along its inner surface) that couple to complementary coupling features disposed on a connector coupling portion (hidden from view) of the connector housing 130.

The handle 150 can have any of a number of shapes. In this case, the handle has a "U" shape, similar to the shape of the handle 120, with a main section 152 that is coupled to an end section 153 at one end of the main section 152 and to another end section 151 at the other end of the main section 152. The handle 150, when coupled to the connector body 160, can form an opening 154 through which a user's hand or some other object can be disposed.

As discussed above, when the electrical connector 100 has two handles (handle 120 and handle 150), the handles are not anchored to each other. As a result, when a user grabs one or both handles, mechanical strain can be applied to the connector end 110 coupled to the connector end 140. As a result, damage can result to the male conductive pins and/or the female conductor receivers of the electrical connector 100. In addition, the connector end 110 and the connector end 140 can become dislodged from each other as a result of the mechanical stress that results from using one or both handles to maneuver the electrical connector 100.

Figure 2:
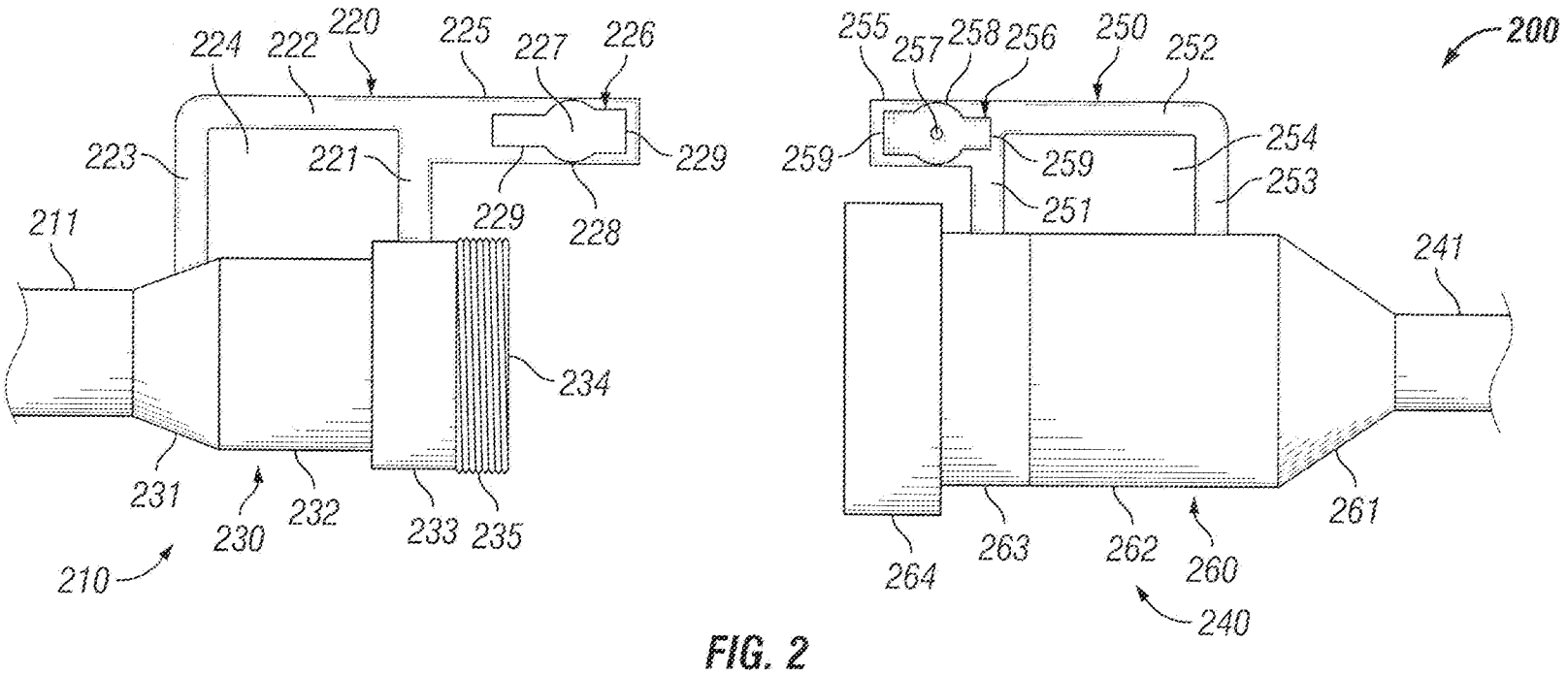
FIG. 2 shows an electrical connector with handles in accordance with certain example embodiments.

To solve these problems, and to provide added safety features to the electrical connector, example embodiments have been developed. For example, FIG. 2 shows an electrical connector 200 with handles in accordance with certain example embodiments. The electrical cable 211, the electrical cable 241, the connector body 230, and the connector body 260 of the electrical connector 200 in FIG. 2 is substantially the same as the electrical cable 111, the electrical cable 141, the connector body 130, and the connector body 160 of the electrical connector 100 in FIG. 1. In this case, since the connector housing 230 and the connector housing 260 of the electrical connector 200 of FIG. 2 are shown separated from each other, the connector coupling features 235 (in this case, mating threads) disposed on a connector coupling portion 234 of the connector housing 230 that couple to the connector coupling features of the connector coupling portion 264 are visible.

The handle 220 and the handle 250 of the electrical connector 200 of FIG. 2 are substantially similar to the handle 120 and the handle 150 of the electrical connector 100 of FIG. 1, except as described below. Specifically, handle 220 has an extension 225 that extends approximately from where the main section 222 is coupled to the end section 221, in this case extending substantially in line with the main section 222. Similarly, handle 250 has an extension 255 that extends approximately from where the main section 252 is coupled to the end section 251, in this case extending substantially in line with the main section 252.

Extension 225 of the handle 220 includes a handle coupling feature 226, and extension 255 of handle 250 includes a handle coupling feature 256 that complements handle coupling feature 226. For example, handle coupling feature 226 in this example is a shaped aperture 227 (also called a keyhole 227) that traverses the thickness of the extension 225. The shape of the aperture 227 can vary, but is configured to complement the shape of the handle coupling feature 256 (described below) of the extension 255 of the handle 250. In this case, the shape of the aperture 227 is round in the middle 228 with linear segments 229 that extend from each side of the middle 228, where the height of the middle 228 is greater than the height of the linear segments 229.

The handle coupling feature 256 disposed on the extension 255 of the handle 250 in this case is a rotatable key mounted on the extension 255 by a coupling feature 257 (e.g., a screw, a bolt, a rivet). Specifically, the handle coupling feature 256 has a shape that has a substantially round middle 258 with linear segments 259 that extend from each side of the middle 258, where the height of the middle 258 is greater than the height of the linear segments 259. The size of the handle coupling feature 256 is substantially the same as, but slightly smaller than, the size of the handle coupling feature 226 so that the handle coupling feature 256 can be disposed within the handle coupling feature 226. In addition, the handle coupling feature 256 can be offset from the extension 255 to an extent that the handle coupling feature 256 can fully protrude through the handle coupling feature 226. In this way, the handle coupling feature 256 can rotate after the handle coupling feature 256 is disposed in the handle coupling feature 226.

In certain alternative embodiments, the handle coupling feature 256 of the handle 250 can be an aperture, and the handle coupling feature 226 of the handle 220 can be a rotatable key. In certain example embodiments, the handle 250 of the connector end 210 can be fixedly coupled to the connector body 260. Alternatively, the handle 250 can be movably (e.g., rotatably, slidably) coupled to the connector body 260. In such a case, the handle 250 and/or the connector body 260 can have one or more features that lock the handle 250 in place relative to the connector body 260 and also release the handle 250 to allow the handle 250 to move relative to the connector body 260. Similarly, the handle 220 can be fixedly or movably coupled to the connector body 230. Further, the handle 250 of the connector end 260 can move independently of the connector coupling portion 264. In this way, the handle coupling feature 256 can be positioned to align with and couple to the handle coupling feature 226 after the connector coupling portion 264 couples to the connector coupling portion 234.

The extension 255 can be fixedly coupled to the rest of the handle 250. Alternatively, the extension 255 can be movable relative to the rest of the handle 250. For example, the extension 255 can retract into (at least partially) and extend from an end of the main section 252. As another example, the extension 255 can have a telescopic configuration so that the extension 255 remains fixedly coupled to the main section 252, but the length of the extension 255 can be adjusted by a user. Similarly, the extension 225 can be fixedly or moveably coupled to the rest of the handle 220, and the extension 225 can be rigid or extendable. In certain example embodiments, the connector coupling portion 235 of the connector end 210 is not fully coupled to the connector coupling portion 264 of the connector end 240 until the handle coupling feature 256 aligns with (is positioned within) the handle coupling feature 226.

Figure 3A:
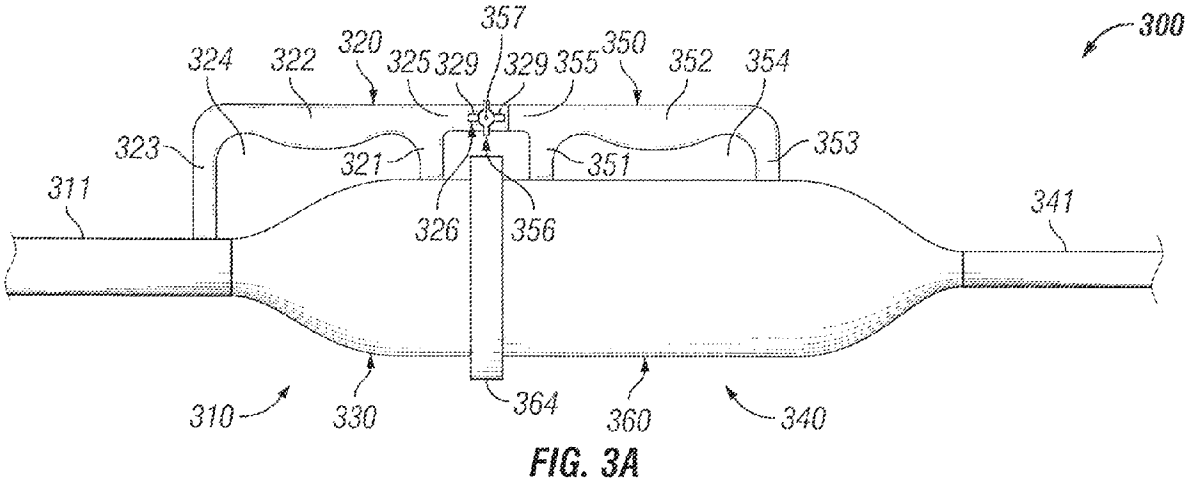
FIGS. 3A and 3B show side views of an electrical connector with handles in accordance with certain example embodiments.
Figure 3B:
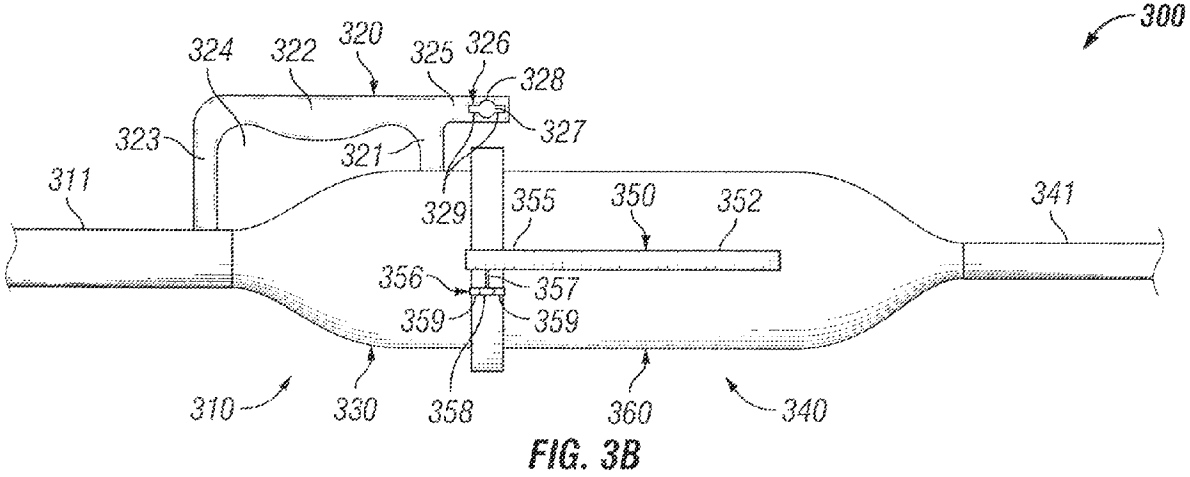

FIGS. 3A and 3B show side views of an electrical connector 300 with handles in accordance with certain example embodiments. Specifically, FIG. 3A shows a side view of the electrical connector 300 with the handle coupling feature 356 coupled to the handle coupling feature 326 (and so with the handle 320 aligned with the handle 350). FIG. 3B shows a side view of the electrical connector 300 with the handle coupling feature 356 decoupled from the handle coupling feature 326 and with the handle 320 no longer aligned with the handle 350. The electrical connector 300 of FIG. 3 is substantially similar to the electrical connector 200 of FIG. 2.

When the handle coupling feature 356 is coupled to the handle coupling feature 326, a user knows that the connector end 310 is properly coupled (electrically and mechanically) to the connector end 340. Also, when the handle coupling feature 356 is coupled to the handle coupling feature 326, a user can use one or both handles (handle 320 and handle 350) to lift and/or otherwise maneuver the electrical connector 300 with a greatly reduced risk of causing mechanical damage to some or all of the electrical connector 300 and with a greatly reduced risk of breaking the electrical continuity between the connector end 310 and the connector end 340.

In FIG. 3B, the connector end 340 is rotated approximately 270° relative to the connector end 310 after the handle coupling feature 356 is decoupled from the handle coupling feature 326. To decouple the handle coupling feature 356 from the handle coupling feature 326, the handle coupling feature is rotated 90 (e.g., clockwise, counterclockwise) so that the shape of the handle coupling feature 356 aligns with the shape of the handle coupling feature 326. When the handle coupling feature 356 and the handle coupling feature 326 are decoupled from each other, the connector end 340 can remain coupled to the connector end 310. Alternatively, as the handle coupling feature 356 rotates away from the handle coupling feature 326, the connector end 340 can become coupled from the connector end 310.

Figure 4A:
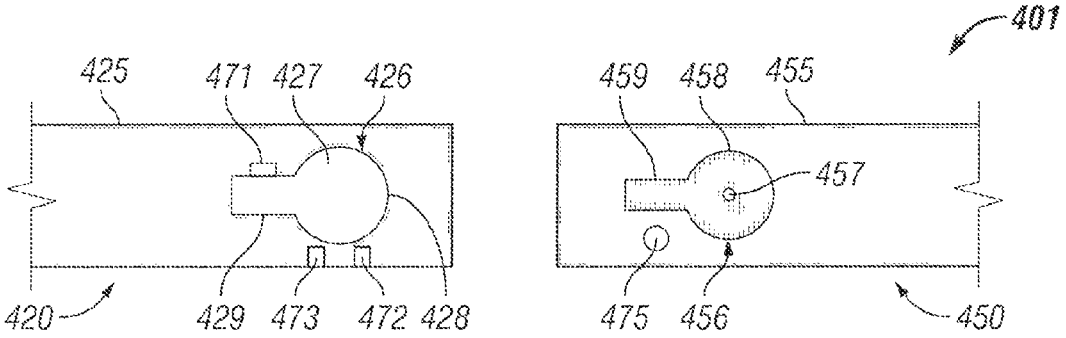
FIGS. 4A-4C show side views of a portion of the handles of an electrical connector in accordance with certain example embodiments.
Figure 4B:
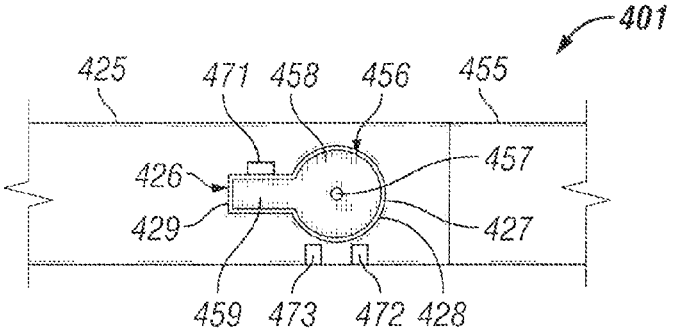
Figure 4C:
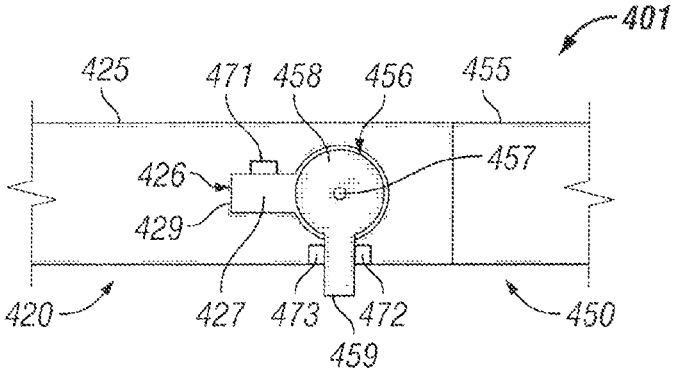

FIGS. 4A-4C show how, in accordance with certain example embodiments, the handle coupling feature 426 and the handle coupling feature 456 become coupled to each other and remain coupled to each other when a user uses one or both handles. FIG. 4A shows a side view of a portion 401 of handle 420 and handle 450 before the handle coupling feature 426 and the handle coupling feature 456 are aligned with each other. FIG. 4B shows a side view of the portion 401 of handle 420 and handle 450 when the handle coupling feature 426 and the handle coupling feature 456 are aligned with each other but before the handle coupling feature 426 and the handle coupling feature 456 become coupled to each other. FIG. 4C shows a side view of the portion 401 of handle 420 and handle 450 when the handle coupling feature 426 and the handle coupling feature 456 are aligned with each other and when the handle coupling feature 426 and the handle coupling feature 456 are coupled to each other.

In this case, the handle coupling feature 426 is an aperture that traverses the width of the extension 425. The shape of the aperture 427 can vary, but is configured to complement the shape of the handle coupling feature 456 (described below) of the extension 455 of the handle 450. In this case, the shape of the aperture 427 is circular section 428 with a linear segment 429 that extends from the side of the circular section 428, where the height of the circular section 428 is greater than the height of the linear segment 429.

The handle coupling feature 456 disposed on the extension 455 of the handle 450 in this case is a rotatable key mounted on the extension 455 by a coupling feature 457 (e.g., a screw, a bolt, a rivet). Specifically, the handle coupling feature 456 has a shape that has a substantially circular section 458 with a linear segment 459 that extends from a side of the circular section 458, where the height of the circular section 458 is greater than the height of the linear segment 459. In other words, the shape of the handle coupling feature 456, when viewed from the front (as in FIGS. 4A-4C) is substantially the same as the shape of the handle coupling feature 426.

The size of the handle coupling feature 456 is substantially the same as, but slightly smaller than, the size of the handle coupling feature 426 so that the handle coupling feature 456 can be disposed within (aligned with) the handle coupling feature 426, as shown in FIG. 4B. As shown in FIG. 4B, the handle coupling feature 456 is in an open position with respect to the handle coupling feature 426. Since the handle coupling feature 456 is offset from the extension 455 to an extent that the handle coupling feature 456 can fully protrude through the handle coupling feature 426, the handle coupling feature 456 can rotate after the handle coupling feature 456 is disposed in the handle coupling feature 426. For example, as shown in FIG. 4C, the handle coupling feature 456 can be rotated (in this case, 90° counter-clockwise) to put the handle coupling feature 456 in a closed position relative to the handle coupling feature 426. In this way, the handles (handle 420 and handle 450) can provide an indication to a user that the electrical connector is fully and correctly coupled to each other, mechanically and electrically.

In certain example embodiments, the handle 420 (or portions thereof) and/or the handle 450 (or portions thereof) can include one or more features that facilitate movement of the handle coupling feature 456 relative to the handle coupling feature 426. For example, as shown in FIGS. 4A-4C, the extension 425 can have two stops (e.g., protrusions) that limit the range of motion of the handle coupling feature 456 relative to the handle coupling feature 426. In this case, the stop 471, located adjacent to the top side of the linear segment 429 of the handle coupling feature 426, can be used to prevent the handle coupling feature 456 from rotating clockwise beyond the open position. In addition, the stop 472, located adjacent to (or near) the bottom side of the circular section 428 of the handle coupling feature 426, can be used to prevent the handle coupling feature 456 from rotating counter-clockwise beyond the closed position.

As another example of a feature of the handle 420 and/or the handle 450 that can facilitate movement of the handle coupling feature 456 relative to the handle coupling feature 426, a retaining feature 473 (e.g., a protrusion (detent) that is rounded and protrudes from the extension 425 less than the stop 471 and the stop 472) can be disposed on the extension 425. In this case, the retaining feature 473 is positioned proximate to the stop 472 and adjacent to (or near) the bottom side of the circular section 428 of the handle coupling feature 426. The distance between the retaining feature 473 and the stop 472 can be substantially the height (or width) of the linear segment 459 of the handle coupling feature 456. In this way, as the handle coupling feature 456 travels counter-clockwise approaching the stop 472, the linear segment 459 rubs against and travels over the retaining feature 473.

Once the linear segment 459 abuts the stop 472 (when the handle coupling feature 456 is in the closed position), the retaining feature 473 abuts against the side the linear segment 459 opposite where the linear segment 459 abuts the stop 472. In such a case, the retaining feature 473 holds the handle coupling feature 456 in the closed position, which serves to make the handle 420 and the handle 450 act like a single handle for the electrical connector. As a result, holding the handle coupling feature 456 in the closed position reduces the likelihood that the handle coupling feature 456 will accidently return to the open position while the electrical connector is being maneuvered by a user. As explained above, if the handle coupling feature 456 returns to the open position while the electrical connector is being maneuvered, the handle coupling feature 456 and the handle coupling feature 426 can be decoupled from each other, which can lead to mechanical damage to and/or an interruption in electrical continuity in the electrical connector or portions thereof.

In certain example embodiments, the handle 420 (or portions thereof) and/or the handle 450 (or portions thereof) can include one or more features that promote safety practices according to industry or facility procedures. For example, as shown in FIG. 4A, the extension 455 of the handle 450 can include a tag coupling feature 475. In this case, the tag coupling feature 475 is an aperture that traverse the thickness of the extension 455. In such a case, the tag coupling feature 475 can receive a lockout tagout tag (not shown), which is used during an outage condition to help prevent the connector end 410 from being used while the lockout tagout tag is disposed in the tag coupling feature 475.

Specifically, when the tag coupling feature 475 is placed in the path of the handle coupling feature 456 (and, more specifically in this case, the linear segment 459), the handle coupling feature 456 cannot be moved to the closed position when a lockout tagout tag is placed in the tag coupling feature 475. Similarly, the handle coupling feature 426, which itself is an aperture 427, can serve as a tag coupling feature in which a lockout tagout tag can be disposed during an outage condition.

Example embodiments provide for an electrical connector with indicating handles. Specifically, certain example embodiments allow for the modified handles on each connector end of an electrical connector so that the handles can become coupled to each other. By coupling the example handles of electrical connectors, the electrical connectors can be lifted and/or otherwise maneuvered by a user with significantly reduced risk of mechanical damage to the electrical connector and reduced risk of disrupting the electrical continuity within the electrical connector. The example indicating handles of electrical connectors described herein can be coupled and decoupled without the use of (or with limited use of) tools. Further, example embodiments provide a user with a visual indication that the connector ends of the electrical connector are fully and completely coupled to each other, mechanically and electrically. Example embodiments may be used with a variety of sizes, quantities, and/or shapes of electrical cable and/or electrical conductor.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An electrical connector, comprising:

a first connector end comprising:

a first connector body comprising a connector coupling feature; and a first handle disposed on a first outer surface of the first connector body, wherein the first handle comprises a handle coupling feature having a plurality of positions; and a second connector end removably coupled to the first connector end, wherein the second connector end comprises:

a second connector body comprising a complementary connector coupling feature, wherein the connector coupling feature of the first connector end couples with the complementary connector coupling feature of the second connector end; and a second handle disposed on a second outer surface of the second connector body, wherein the second handle comprises a complementary handle coupling feature, wherein the complementary handle coupling feature comprises a keyhole, wherein the handle coupling feature traverses the keyhole of the complementary handle coupling feature when the handle coupling feature is in a first position and when the connector coupling feature couples to the complementary connector coupling feature, and wherein the handle coupling feature couples to the complementary handle coupling feature when the handle coupling features moves out of the first position while the handle coupling feature traverses the keyhole.

2. The electrical connector of claim 1, wherein the handle coupling feature moves out of the first position by rotating.

3. The electrical connector of claim 2, wherein the handle coupling feature is moved out of the first position to a second position, wherein the second position of the handle coupling feature keeps the handle coupling feature coupled to the complementary handle coupling feature and prevents the handle coupling feature from traversing back through the keyhole.

4. The electrical connector of claim 3, wherein the second handle further comprises a retaining feature that keeps the handle coupling feature in the second position.

5. The electrical connector of claim 3, wherein the first handle and the second handle form a continuous handle when the handle coupling feature couples to the complementary handle coupling feature.

6. The electrical connector of claim 1, wherein the handle coupling feature is unable to traverse the keyhole unless the handle coupling feature is in the first position.

7. The electrical connector of claim 1, wherein the complementary handle coupling feature is configured to receive a lockout tagout tag when the handle coupling feature is disposed outside of the keyhole of the complementary handle coupling feature.

8. The electrical connector of claim 1, wherein the first handle further comprises a tag coupling feature, wherein the tag coupling feature is configured to receive a lockout tagout tag when the handle coupling feature is disposed outside of the keyhole of the complementary handle coupling feature.

9. The electrical connector of claim 1, wherein the connector coupling feature rotatably couples with the complementary connector coupling feature.

10. The electrical connector of claim 1, wherein the first connector end and the second connector end are used for a photovoltaic solar system.

11. The electrical connector of claim 1, wherein the handle coupling feature is movable with respect to a remainder of the first handle.

12. A connector end of an electrical connector, the connector end comprising:

a connector body comprising a connector coupling feature; and a handle disposed on an outer surface of the connector body, wherein the handle comprises a handle coupling feature having a plurality of positions, wherein the connector coupling feature is configured to couple to a complementary connector coupling feature of another connector body of a complementary connector end, and wherein the handle coupling feature is configured to traverse a keyhole of and couple to a complementary handle coupling feature of a complementary handle of the complementary connector end, wherein the handle coupling feature is configured to traverse the keyhole of the complementary handle coupling feature when the handle coupling feature is in a first position and when the connector coupling feature couples to the complementary connector coupling feature, and, wherein the handle coupling feature is configured to couple to the complementary handle coupling feature when the handle coupling feature moves out of the first position while the handle coupling feature traverses the keyhole.

13. The connector end of claim 12, wherein the connector handle coupling feature moves out of the first position by rotating.

14. The connector end of claim 12, wherein the handle coupling feature is moved to a second position when the handle coupling feature is aligned with the complementary handle coupling feature, wherein the handle coupling feature, when in the second position, prevents the handle coupling feature from decoupling with the complementary handle coupling feature.

15. The connector end of claim 12, wherein the handle further comprises a tag coupling feature, wherein the tag coupling feature is configured to receive a lockout tagout tag when the handle coupling feature is disposed outside of the keyhole of the complementary handle coupling feature.

16. The connector end of claim 12, wherein the handle coupling feature is disposed on an extension of the handle.

17. A connector end of an electrical connector, the connector end comprising:

a connector body comprising a connector coupling feature; and a handle disposed on an outer surface of the connector body, wherein the handle comprises a handle coupling feature, wherein the handle coupling feature comprises a keyhole, wherein the connector coupling feature is configured to couple to a complementary connector coupling feature of another connector body of a complementary connector end, and wherein the keyhole of the handle coupling feature is configured to be traversed by a complementary handle coupling feature of a complementary handle of the complementary connector end, wherein the keyhole of the handle coupling feature is configured to be traversed when the complementary handle coupling feature is in a first position of a plurality of positions and when the connector coupling feature couples to the complementary connector coupling feature, and, wherein the handle coupling feature is configured to couple to the complementary handle coupling feature when the complementary handle coupling feature moves out of the first position while the complementary handle coupling feature traverses the keyhole.

18. The connector end of claim 17, wherein the handle further comprises at least one retaining feature that keeps the complementary handle coupling feature in a second position.

19. The connector end of claim 17, wherein the handle further comprises at least one stop that limits a range of motion of the complementary handle coupling feature between the first position and a second position.

20. The connector end of claim 17, wherein the handle coupling feature is configured to receive a lockout tagout tag when the complementary handle coupling feature is disposed outside of the keyhole of the handle coupling feature.

* * * * *